US006802533B1

(12) United States Patent
Blomquist

(10) Patent No.: US 6,802,533 B1
(45) Date of Patent: Oct. 12, 2004

(54) GAS GENERATING MATERIAL FOR VEHICLE OCCUPANT PROTECTION DEVICE

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/553,137

(22) Filed: Apr. 19, 2000

(51) Int. Cl.[7] ..... C06B 45/10
(52) U.S. Cl. ..... 280/741; 149/19.4; 149/19.6
(58) Field of Search ..... 149/19.4, 19.6; 280/741

(56) References Cited

U.S. PATENT DOCUMENTS

| | | | | | |
|---|---|---|---|---|---|
| 4,393,199 | A | * | 7/1983 | Manser | 149/19.6 |
| 4,506,069 | A | | 3/1985 | Barnes et al. | |
| 4,657,607 | A | | 4/1987 | Perotto et al. | |
| 4,806,613 | A | * | 2/1989 | Wardle | 149/19.4 |
| 4,919,737 | A | * | 4/1990 | Biddle et al. | 149/19.5 |
| 4,978,482 | A | * | 12/1990 | Johnson et al. | 149/19.9 |
| 5,092,945 | A | | 3/1992 | Reed, Jr. et al. | |
| 5,164,521 | A | * | 11/1992 | Manzara et al. | 149/19.6 |
| 5,210,153 | A | * | 5/1993 | Manser et al. | 149/19.6 |
| 5,319,037 | A | * | 6/1994 | Gomez et al. | 525/403 |
| 5,525,171 | A | * | 6/1996 | Finck et al. | 149/19.1 |
| 5,551,725 | A | * | 9/1996 | Ludwig | 280/741 |
| 5,552,257 | A | * | 9/1996 | Stewart et al. | 149/19.6 |
| 5,589,661 | A | * | 12/1996 | Menke et al. | 149/19.1 |
| 5,591,936 | A | | 1/1997 | Willer et al. | |
| 5,596,168 | A | * | 1/1997 | Menke et al. | 149/19.1 |
| 5,741,998 | A | | 4/1998 | Hinshaw et al. | |
| 5,847,311 | A | | 12/1998 | Ryder | |
| 5,868,424 | A | * | 2/1999 | Hamilton et al. | 280/741 |
| RE36,296 | E | * | 9/1999 | Zeigler | 149/19.6 |
| 6,062,143 | A | * | 5/2000 | Grace et al. | 102/530 |
| 6,074,502 | A | * | 6/2000 | Burns et al. | 149/46 |
| 6,143,103 | A | * | 11/2000 | Ryder | 149/19.6 |

OTHER PUBLICATIONS

Hawley, The Condensed Chemical Dictionary, 9$^{th}$ Edition, (1977) Van Nostrand Reinhold Company, New York, pp. 116, 700–701, and 705–706.*

* cited by examiner

*Primary Examiner*—Edward A. Miller
(74) *Attorney, Agent, or Firm*—Tarolli, Sundheim, Covell & Tummino L.L.P.

(57) ABSTRACT

An apparatus (10) comprises an inflatable vehicle occupant protection device (20) and a gas generating material (16) that, when ignited, produces gas to inflate the inflatable vehicle occupant protection device (20). The gas generating material (16) comprises a polyurethane thermoplastic elastomer and an inorganic salt oxidizer. The polyurethane elastomeric material comprises a physically cross-linked linear copolymer of an aromatic diisocyanate and a linear energetic polymer having a hydroxyl functionality of two or less.

9 Claims, 1 Drawing Sheet

GAS GENERATING MATERIAL FOR VEHICLE OCCUPANT PROTECTION DEVICE

FIELD OF THE INVENTION

The present invention relates to a gas generating material. The gas generating material is particularly useful for inflating a vehicle occupant protection device.

BACKGROUND OF THE INVENTION

An inflatable vehicle occupant protection device, such as an air bag, is inflated by gas provided by an inflator. The inflator contains a gas generating material. The inflator further includes an igniter. The igniter is actuated to ignite the gas generating material when the vehicle experiences a collision for which inflation of the air bag is desired. As the gas generating material burns, it generates a volume of inflation gas. The inflation gas is directed into the air bag to inflate the air bag. When the air bag is inflated, it expands into the vehicle occupant compartment and helps to protect the vehicle occupant.

A convenient way of making a gas generating material is by extrusion. Gas generating material that is extruded can be configured into a variety of structural shapes, including rods, pellets, and other shapes. Conventional extrusion of gas generating material requires formulating the gas generating material with a thermoplastic elastomer binder. Thermoplastic elastomer binders conventionally have a low oxygen content. This requires formulating the gas generating material with a relatively large amount of an oxidizer to oxygen balance the gas generating material and produce a combustion product which is substantially smoke-free and substantially free of toxic materials. The use of a large amount of oxidizer, however, makes extrusion processing difficult.

Moreover, it is desirable to recycle gas generating material that has not been ignited. This avoids disposing the gas generating material in a land fill. However, conventional thermoplastic elastomer binders in gas generating material are cross-linked by chemical bonds such as covalent bonds. Covalent bonds are difficult to break, thus making it difficult to convert the gas generating material to its original ingredients for recycling.

SUMMARY OF THE INVENTION

The present invention is an apparatus comprising an inflatable vehicle occupant protection device and a gas generating material that, when ignited, produces gas to inflate the inflatable vehicle occupant protection device. The gas generating material comprises a polyurethane thermoplastic elastomer and an inorganic salt oxidizer. The polyurethane elastomeric material comprises a physically cross-linked linear copolymer of an aromatic diisocyanate and a linear energetic polymer having a hydroxyl functionality of two or less.

BRIEF DESCRIPTION OF THE DRAWINGS

Further features of the present invention will become apparent to those skilled in the art to which the present invention relates, from consideration of the following specification, with reference to the accompanying drawing which is a schematic illustration of an apparatus embodying the present invention.

DESCRIPTION OF PREFERRED EMBODIMENTS

Figure 1:
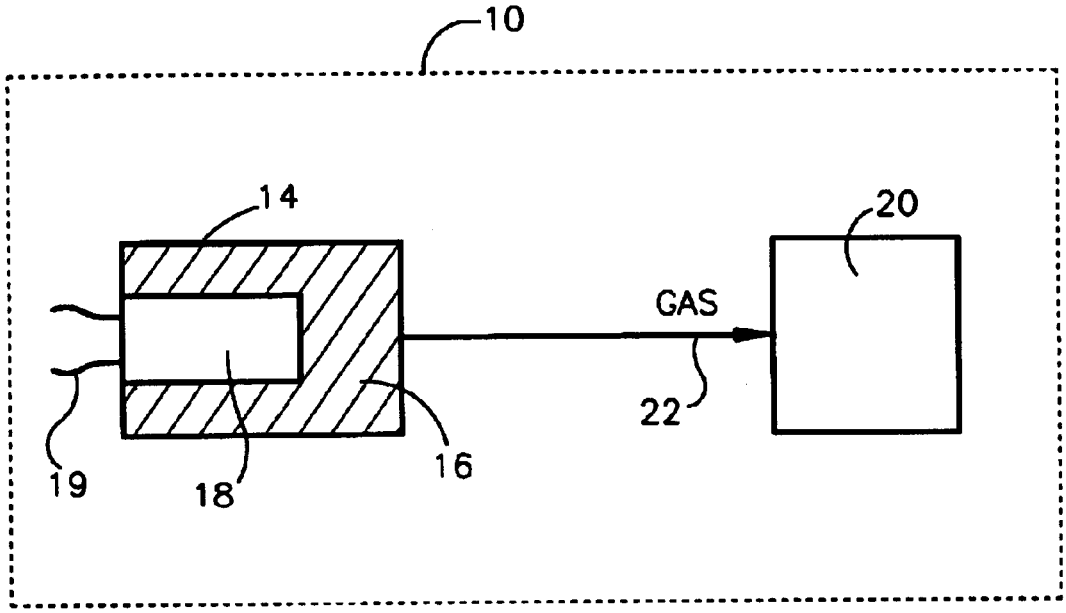

Referring to the FIG. 1, an apparatus 10 embodying the present invention comprises an inflator 14. The inflator 14 contains a generating material 16. The gas generating material 16 is ignited by an igniter 18 operatively associated with the gas generating material 16. Electric leads 19 convey current to the igniter 18 and are part of an electric circuit that includes a sensor (not shown), which is responsive to vehicle deceleration above a predetermined threshold. The apparatus 10 also comprises a vehicle occupant protection device 20. A gas flow means 22 conveys gas, which is generated by combustion of the gas generating material 16, to the vehicle occupant protection device 20.

A preferred vehicle occupant protection device 20 is an air bag that is inflatable to protect a vehicle occupant in the event of a collision. Other vehicle occupant protection devices that can be used in the present invention are inflatable seat belts, inflatable knee bolsters, inflatable air bags to operate knee bolsters, inflatable head liners, and/or inflatable side curtains.

The gas generating material 16 of the present invention comprises an inorganic salt oxidizer dispersed in a polyurethane thermoplastic elastomer. The polyurethane thermoplastic elastomer functions as the primary fuel component in the gas generating material 16. Additionally, the polyurethane thermoplastic elastomer functions as a solid binder material for the inorganic salt oxidizer and other ingredients in the gas generating material 16, such as supplemental fuels, burn rate catalysts, and coolants.

The inorganic salt oxidizer of the present invention can be any inorganic salt oxidizer commonly used in a gas generating material for providing inflation gas for inflating a vehicle occupant protection device. Examples of an inorganic salt oxidizer that can be used in the gas generating material of the present invention are alkali metal nitrates, alkaline earth metal nitrates, alkali metal perchlorates, alkaline earth metal perchlorates, ammonium perchlorate and ammonium nitrate.

A preferred inorganic salt oxidizer is ammonium nitrate. Ammonium nitrate is preferred because it produces upon combustion with the polyurethane thermoplastic elastomer a gas product essentially free of smoke and toxic gases.

When ammonium nitrate is used as the inorganic salt oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can be also be stabilized by doping with copper and zinc ions. Other compounds, modifiers, and methods that are effective to phase stabilize ammonium nitrate are well known and suitable in the present invention.

The amount of inorganic salt oxidizer in the gas generating material is that amount necessary to achieve sustained combustion of the gas generating material. A preferred amount of inorganic salt oxidizer is in the range of about 65% to about 90% by weight based on the weight of the gas generating material.

Preferably, the inorganic salt oxidizer is ground into two fractions, one being a coarse fraction, for instance, having an average particle size of about 100 to about 600 microns, and the other being a fine fraction, for instance, having an average particle size of about 10 to about 60 microns. The amount of the coarse fraction in the gas generating material is preferably in the range of about 50% to about 75% by weight, based on the weight of the inorganic salt oxidizer. The amount of the fine fraction in the gas generating material is preferably about 25% to about 50% by weight, based on the weight of the inorganic salt oxidizer.

The polyurethane thermoplastic elastomer of the present invention comprises linear copolymers that are physically cross-linked by hydrogen bonds.

The polyurethane thermoplastic elastomer is formed by mixing a crystalline monomer with an amorphous polymer. The crystalline monomer is an aromatic diisocyanate. A preferred aromatic diisocyanate is 4,4'-methylene bis-phenyl isocyanate.

The amorphous polymer is a linear energetic polymer with a hydroxyl functionality of two or less. A hydroxyl functionality of two or less is critical in order to prevent the linear energetic polymer, when mixed with the aromatic diisocyanate, from forming branched copolymers or copolymers that are cross-linked by covalent bonds.

Preferred linear energetic polymers with a hydroxyl functionality of two or less are glycidyl azide polymers such as GAP 500, GAP 1000, and GAP 2000. GAP 500, GAP 1000, and GAP 2000 are commercially available from the Specialty Chemicals Division of 3M Company of St. Paul, Minnesota. GAP 500 has an average molecular weight of about 500 g/mole and a hydroxyl functionality of two. GAP 1000 has an average molecular weight of 1000 g/mole and a hydroxyl functionality of two. GAP 2000 has an average molecular weight of about 2000 g/mole and a hydroxyl functionality of two.

Glycidyl azide polymer is preferred as the linear energetic polymer because glycidyl azide polymer produces upon combustion a high amount of heat per unit weight (i.e. about 200 calories per gram) compared to other linear energetic polymers. Moreover, a polyurethane thermoplastic elastomer formed from glycidyl azide polymer and aromatic diisocyanate produces, upon combustion with the inorganic salt oxidizer, a combustion product essentially free of smoke and toxic gases.

Examples of other linear energetic polymers that can be used in present invention are nitramine polymers such as poly-glycidyl nitrate (PGN), oxetane polymers such as poly-nitratomethyl-methyl oxetane (poly-NMMO), poly-bisazido-methyloxetane (poly-BAMO), poly-azidomethyl-methyloxetane (poly-AMMO), and poly-nitraminomethyl-methyloxetane (poly-NAMMO), and oxirane polymers such as diethyleneglycoltriethyleneglycolnitraminodiacetic acid terpolymer (9DT-NIDA), all formulated with a hydroxyl functionality of two or less.

The amounts of aromatic diisocyanate and linear energetic polymer mixed together are controlled so that the ratio of the isocyanate groups of the aromatic diisocyanate to the hydroxyl groups of the linear energetic polymer (i.e. NCO/OH ratio) is about 1. A NCO/OH ratio of greater than about 1 results in copolymers that are cross-linked by covalent bonds. A NCO/OH ratio less than 1 will lead to incomplete reaction of the aromatic isocyanate with the linear energetic polymer and the formation of a thermoplastic polyurethane elastomer that has poor mechanical properties.

The isocyanate groups of the aromatic diisocyanate and the hydroxyl groups of the linear energetic polymers react, in a urethane type reaction, to form linear copolymers with urethane linkages. The linear copolymers have alternating sequences of elastomeric segments and thermoplastic segments. The elastomeric segments are provided by the linear energetic polymer and the thermoplastic segment are provided by the urethane linkage.

In a preferred embodiment, 4,4'-methylene bis-phenylisocyanate is reacted with GAP 1000 to form linear copolymers (i.e. GAP-M). The reaction scheme of this process is illustrated as follows:

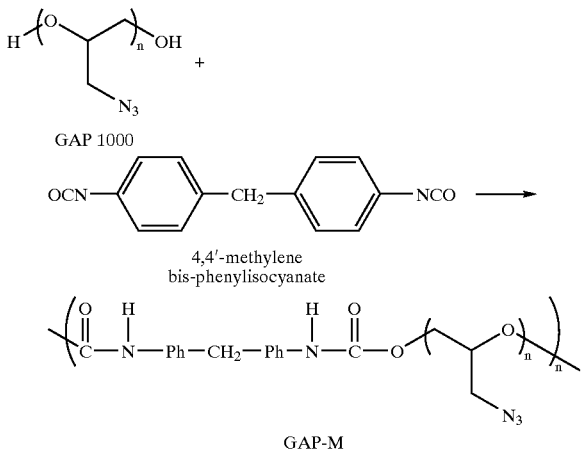

The linear copolymers formed from 4,4'-methylene bis-phenylisocyanate and GAP 1000 (i.e. GAP-M) have an average molecular weight of about 25,000 g/mole to about 35,000 g/mole.

Each of the urethane linkages within the copolymers so formed are capable of forming hydrogen bonds with an oxygen of the urethane linkage of another linear copolymer or with an oxygen of the linear energetic polymer of another linear copolymer. By doing so, the linear copolymers physically cross-link and form the polyurethane thermoplastic elastomer.

The polyurethane thermoplastic elastomer can be a soft rubbery mass or a rigid plastic depending upon the weight % of the thermoplastic segments in the polyurethane thermoplastic elastomer. The higher the weight % of the thermoplastic segments in the polyurethane thermoplastic elastomer, the more rigid the polyurethane thermoplastic elastomer. Conversely, the lower the weight % of the thermoplastic segments in the polyurethane thermoplastic elastomer, the less rigid (i.e. softer) the polyurethane thermoplastic elastomer. A preferred weight % of thermoplastic segments in the polyurethane thermoplastic elastomer is that weight % sufficient to form a polyurethane thermoplastic elastomer, which is a resilient solid capable of withstanding shock without permanent deformation. More preferably, the weight % of the thermoplastic segments in the polyurethane thermoplastic elastomer is from about 20% to about 40% by weight of the polyuretheane thermoplastic elastomer.

The weight % of the thermoplastic segments in the polyurethane thermoplastic polymer is dependent on the molecular weight of the linear energetic polymer. The higher the molecular weight of the linear energetic polymer, the lower the weight % of the thermoplastic segments in the polyurethane thermoplastic elastomer. Conversely, the lower the molecular weight of the linear energetic polymer, the higher the weight % of the thermoplastic segments in the polyurethane thermoplastic elastomer.

The weight % of the thermoplastic segment in the polyurethane thermoplastic elastomer can-be increased by adding a secondary diol, such as 2,4-pentanediol, to the mixture of aromatic diisocyanate and linear energetic polymer. The amount of aromatic diisocyanate, linear energetic polymer, and secondary diol in this mixture must be controlled so that the ratio of the isocyanate groups of the aromatic diisocyanate to the hydroxyl groups of the linear energetic polymer and secondary diol (i.e. NCO/OH ratio) is about 1.

The weight % of polyurethane thermoplastic elastomer in the gas generating material is that weight % sufficient to achieve sustained combustion of the gas generating material. A preferred weight % is from about 5% to about 35% based on the weight of the gas generating material.

The gas generating material of the present invention may comprise other ingredients in addition to the inorganic salt oxidizer and the polyurethane thermoplastic elastomer. For instance, the gas generating material may comprise a supplemental fuel. Preferred, supplemental fuels are organic fuels that are not azides. Examples of organic fuels that are not azides are organic nitrates or nitro-organics such as nitroguanidine (NQ), guanidine nitrate (GN), triamino guanidine nitrate (TAGN), tetramethyl ammonium nitrate, cyclotrimethylenetrinitramine (RDX), cyclotetramethylenetetranitramine (HMX), and nitrocellulose, azoles including triazoles and tetrazoles such as 5-aminotetrazole (%-AT) and 3-nitro-1,2,4-triazole-5-one (NTO), oxamide, and urea and urea salts. The amount of supplemental fuel may be in the range of 0 to about 30% by weight based on the weight of the gas generating material.

The present invention may also include 0 to about 10% by weight of other ingredients commonly added to a gas generating material for providing inflation gas for inflating an inflatable vehicle occupant protection device, such as plasticizers, process aids, coolants, burn rate modifiers, and ignition aids.

Preferably, the components of the gas generating material are present in a weight ratio adjusted to produce upon combustion a reaction gas product that consists essentially of carbon dioxide, nitrogen, and water.

The gas generating material is prepared by adding, to a conventional mixer, the polyurethane thermoplastic elastomer and a solvent. The solvent is an organic solvent that readily dissolves the polyurethane thermoplastic elastomer by causing dissociation of the hydrogen bonds that cross-link the copolymer chains of the polyurethane thermoplastic elastomer. A preferred solvent that causes dissociation of the hydrogen bonds which cross-link the copolymers of the polyurethane thermoplastic elastomer is ethyl acetate.

The polyurethane thermoplastic elastomer and solvent are mixed until a viscous, yet still fluid solution is formed. The solution of polyurethane thermoplastic elastomer is poured into an extruder such as a heat jacketed twin screw extruder. The inorganic salt oxidizer and other ingredients such as supplemental fuel, burn rate modifier, plasticizer and coolant, if utilized, are added to and mixed with the solution of polyurethane thermoplastic elastomer. Alternatively, the inorganic salt oxidizer, and other ingredients such as supplemental fuel, burn rate modifier, plasticizer and coolant, if utilized, can be mixed with the solution of polyurethane thermoplastic elastomer prior to placing the solution of polyurethane thermoplastic elastomer in the extruder. The inorganic salt oxidizer forms a viscous slurry, having a dough like consistency, with the solution of polyurethane thermoplastic elastomer.

The viscous slurry is advanced from the extruder, through a shaping device or die with a predetermined diameter, and cut to desired length. The body of gas generating material so formed may be in the shape of a single grain or a plurality of grains. The body of gas generating material shaped into a plurality of grains has a configuration, similar to that of an aspirin table. Preferably, the body of gas generating material contains surface area increasing features such as perforations or slots. Perforations or slots enhance mass flow of the combustion product away from the grains during combustion of the grains.

The solvent is evaporated from the body of gas generating material by heating the body of gas generating material at an elevated temperature (i.e. about 50° C. to about 60° C.). Removal of the solvent causes the linear copolymers of the polyurethane thermoplastic elastomer to cross-link physically and form an elastic matrix within the body of gas generating material. The gas generating material is generally a resilient solid, like a hard rubber, capable of withstanding shock without permanent deformation at 85° C. and not brittle at 40° C.

An advantage of the gas generating material of the present invention is that it can be easily recycled, unlike gas generating material formed from conventional thermoplastic elastomers. The gas generating material is recycled by mixing the gas generating material with an organic solvent, such as ethyl acetate, which dissolves the polyurethane thermoplastic elastomer by causing dissociation of the hydrogen bonds which cross-link the linear copolymers of the polyurethane thermoplastic elastomer. The inorganic salt oxidizer and other ingredients, such as supplemental fuel, burn rate modifier, plasticizer, and coolant, are recovered from the solution of gas generating material and organic solvent by extraction. The remaining solvent is evaporated from the solution, leaving the polyurethane thermoplastic elastomer.

EXAMPLES 1–8

Examples 1–8 illustrate the use of a polyurethane thermoplastic elastomer, prepared from GAP 1000 and 4,4-methylen bis-phenylisocyante (i.e. GAP-M), and an inorganic salt oxidizer in the gas generating material of the present invention. In Examples 1–8, the inorganic salt oxidizers are, respectively, ammonium nitrate (Example 1), ammonium nitrate phase stabilized with potassium nitrate (Example 2), ammonium nitrate phase stabilized with zinc oxide (Example 3), potassium nitrate (Example 4), potassium perchlorate (Example 5), ammonium perchlorate (Example 6), potassium nitrate in combination with ammonium perchlorate (Example 7), and ammonium nitrate (Example 8). Cyclotrimethylenetrinitramine (RDX) has been added to Example 8 as a supplemental fuel.

The formulations for Examples 1–8 are given in Table 1 and the combustion results for Examples 1–8 are given in Table 2. The combustion results for Examples 1–8 are calculated using the U.S. Navy PEP Thermochemical Equilibrium Code.

TABLE 1

| | EX 1 | EX 2 | EX 3 | EX 4 | EX 5 | EX 6 | EX 7 | EX 8 |
|---|---|---|---|---|---|---|---|---|
| GAP-M wt % | 14.3 | 16.8 | 14.1 | 20.9 | 27.8 | 31.2 | 28.4 | 7.15 |
| AN wt % | 85.7 | 70.7 | 83.3 | | | | | 67.35 |
| KN wt % | | 12.5 | | 79.1 | | | 33.1 | |
| ZnO wt % | | | 2.6 | | | | | |
| KP wt % | | | | | 72.2 | | | |
| AP wt % | | | | | | 68.8 | 38.5 | |
| RDX wt % | | | | | | | | 25.5 |

TABLE 2

| | EX 1 | EX 2 | EX 3 | EX 4 | EX 5 | EX 6 | EX 7 | EX 8 |
|---|---|---|---|---|---|---|---|---|
| | | | | Chamber Results at 2000 psi | | | | |
| Flame Temp, K. | 2459 | 2415 | 2433 | 2184 | 3192 | 3021 | 2887 | 2724 |
| Impetus, lbf-s/lbm | 394,918 | 321,440 | 342,441 | 145,761 | 281,304 | 324,801 | 374,746 | 374,746 |
| Gas, mol/100 g | 4.242 | 3.966 | 4.167 | 1.847 | 2.612 | 3.990 | 3.326 | 4.105 |
| | | | | Exhaust Results at 20 psi | | | | |
| Temp, K. | 1089 | 1190 | 1089 | 1485 | 1896 | 1317 | 1412 | 1264 |
| Impetus, lbf-s/lbm | 160,644 | 158,517 | 157,923 | 96,462 | 157,421 | 182,861 | 157,109 | 177,632 |
| Gas, mol/100 g | 4.22 | 3.837 | 4.138 | 1.756 | 2.473 | 3.956 | 3.218 | 4.061 |
| Ratio $H_2O/N_2/CO_2$ | 2.50/ 1.28/ 0.43 | 2.14/ 1.26 0.42 | 2.45/ 1.126/ 0.42 | 0.49/ 0.70 0.42 | 0.70 0.42 0.83 | 1.19/ 0.76 0.59 | 1.15/ 0.75/ 0.59 | 2.18/ 1.29/ 0.55 |
| Residue, mol/100 g | 0 | 0.168 ($K_2CO_3$) | 0.016 ($Zn_2CO_3$) | 0.347 ($K_2CO_3$) | 0.483 (KCl) | 0.586 (HCl) | 0.326 (KCl) | 0 |

Referring to Table 1 and Table 2, Example 1 contains by weight of the gas generating material 14.3% GAP-M and 85.7% ammonium nitrate (AN) for substantially complete combustion of the carbon atoms in the GAP-M to carbon dioxide. The flame temperature, exhaust temperature, and amount of residue produced in Example 1 meet criteria for a gas generating composition for inflating a vehicle occupant protection device. The amount of gas produced upon combustion and its energy (impetus) are effective for actuating a vehicle occupant protection device such as an air bag.

Example 2 contains by weight of the gas generating material 16.8% GAP-M and 70.7% ammonium nitrate (AN) phase stabilized with 12.5% potassium nitrate (KN), for substantially complete combustion of the carbon atoms in the GAP-M to carbon dioxide. The flame temperature, exhaust temperature, and amount of residue produced in Example 2 meet criteria for a gas generating composition for inflating a vehicle occupant protection device. The amount of gas produced upon combustion and its energy (impetus) are effective for actuating a vehicle occupant protection device such as an air bag.

Example 3 contains by weight of the gas generating material 14.1% GAP-M and 83.3% ammonium nitrate (AN) phase with 2.6% zinc oxide (ZnO), for substantially complete combustion of the carbon atoms in the GAP-M to carbon dioxide. The flame temperature, exhaust temperature, and amount of residue produced in Example 3 meet criteria for a gas generating composition for inflating a vehicle occupant protection device. The amount of gas produced upon combustion and its energy (impetus) are effective for actuating a vehicle occupant protection device such as an air bag.

Example 4 contains by weight of the gas generating material 20.9% GAP-M and 79.1% potassium nitrate, for substantially complete combustion of the carbon atoms in the GAP-M to carbon dioxide. The flame temperature, exhaust temperature, and amount of residue produced in Example 4 meet criteria for a gas generating composition for inflating a vehicle occupant protection device. The amount of gas produced upon combustion and its energy (impetus) are effective for actuating a vehicle occupant protection device such as an air bag.

Example 5 contains by weight of the gas generating material 27.8% GAP-M and 72.2% potassium perchlorate (KP), for substantially complete combustion of the carbon atoms in the GAP-M to carbon dioxide. The flame temperature, exhaust temperature, and amount of residue produced in Example 5 meet criteria for a gas generating composition for inflating a vehicle occupant protection device. The amount of gas produced upon combustion and its energy (impetus) are effective for actuating a vehicle occupant protection device such as an air bag.

Example 6 contains by weight of the gas generating material 31.2% GAP-M and 68.8% ammonium perchlorate (AP) for substantially complete combustion of the carbon atoms in the GAP-M to carbon dioxide. The flame temperature, exhaust temperature, and amount of residue produced in Example 6 meet criteria for a gas generating composition for inflating a vehicle occupant protection device. The amount of gas produced upon combustion and its energy (impetus) are effective for actuating a vehicle occupant protection device such as an air bag.

Example 7 contains by weight of the gas generating material 28.4% GAP-M and 33.1% potassium nitrate (KN) and 38.5% ammonium perchlorate (AP), for substantially complete combustion of the carbon atoms in the GAP-M to carbon dioxide. The flame temperature, exhaust temperature, and amount of residue produced in Example 7 meet criteria for a gas generating composition for inflating a vehicle occupant protection device. The amount of gas produced upon combustion and its energy (impetus) are effective for actuating a vehicle occupant protection device such as an air bag.

Example 8 contains by weight of the gas generating material 7.15% GAP-M, 67.35% ammonium nitrate (AN), and 25.5% cyclotrimethylenetrinitramine (RDX) for substantially complete combustion of the carbon atoms in the gas generating material to carbon dioxide. The flame temperature, exhaust temperature, and amount of residue produced in Example 8 meet criteria for a gas generating composition for inflating a vehicle occupant protection device. The amount of gas produced upon combustion and its energy (impetus) are effective for actuating a vehicle occupant protection device such as an air bag.

The present invention takes advantage of the favorable performance characteristics of using a polyurethane thermoplastic elastomer and inorganic salt oxidizer in a gas generating material for providing inflation gas for inflating an inflatable vehicle occupant protection device. A gas generating material that comprises a polyurethane thermoplastic elastomer and inorganic salt oxidizer can be easily processed by extrusion because the gas generating material forms a resilient solid without the addition of a plasticizer. Furthermore, the gas generating material of the present invention produces a gas product that is essentially non-toxic and free of particulates. Moreover, the gas generating material ingredients can be easily recycled because the polyurethane thermoplastic elastomer is readily soluble in organic solvents such as ethyl acetate.

From the above description of the invention, those skilled in the art will perceive improvements, changes and modifications. Such improvements, changes and modifications within the skill of the art are intended to be covered by the appended claims.

Having described the invention the following is claimed:

1. An apparatus comprising an inflatable vehicle occupant protection device and a gas generating material that, when ignited produces gas to inflate the inflatable vehicle occupant protection device, the gas generating material comprising:

an inorganic oxidizer salt; and a thermoplastic elastomer, said thermoplastic elastomer consisting essentially of a polyurethane formed from aromatic diisocyanate, hydroxyl terminated glycidyl azide polymer with a hydroxyl functionality of two or less, and 2,4-pentanediol, wherein the amount of aromatic diisocyanate, hydroxyl terminated glycidyl azide polymer, and 2,4-pentanediol used to form the polyurethane are controlled so that the ratio of isocyanate groups to hydroxyl groups used to form the polyurethane is about 1.

2. The apparatus of claim 1 wherein the aromatic diisocyanate is 4,4'-methylene bis-phenylisocyanate.

3. The apparatus of claim 1 wherein the hydroxyl terminated glycidyl azide polymer has a molecular weight from about 25,000 g/mole to about 35,000 g/mole and a hydroxyl functionality of 2.

4. The apparatus of claim 1 wherein the inorganic salt oxidizer is selected from the group consisting of alkali metal nitrates, alkaline earth metal nitrate, alkali metal perchlorates, alkaline earth metal perchlorates, ammonium perchlorate, and ammonium nitrate.

5. The apparatus of claim 1 wherein the inorganic salt oxidizer is phase stabilized ammonium nitrate.

6. The apparatus of claim 1 wherein the gas generating material further comprises a supplemental fuel.

7. The apparatus of claim 6 wherein the supplemental fuel is cyclotrimethylenetrinitamine.

8. The apparatus of claim 1 wherein the components of the gas generating material are present in a weight ratio adjusted to produce upon combustion a reaction gas product that consists essentially of carbon dioxide, nitrogen, and water.

9. An apparatus comprising an inflatable vehicle occupant protection device and a gas generating material that, when ignited produces gas to inflate the inflatable vehicle occupant protection device, the gas generating material comprising:

about 65% to about 90%, by weight of the gas generating material, an inorganic oxidizer salt; and about 5% to about 35%, by weight of the gas generating material a thermoplastic elastomer, said thermoplastic elastomer being a polyurethane formed from 4,4'-methylene bis-phenylisocyanate, a hydroxyl terminated glycidyl azide polymer with a hydroxyl functionality of two or less, and 2,4 pentanediol, wherein the amount of 4,4'-methylene bis-phenylisocyanate, hydroxyl terminated glycidyl azide polymer, and 2,4-pentanediol used to form the polyurethane are controlled so that the ratio of isocyanate groups to hydroxyl groups used to form the polyurethane is about 1.

* * * * *